US007168651B2

(12) United States Patent
Markkanen et al.

(10) Patent No.: US 7,168,651 B2
(45) Date of Patent: Jan. 30, 2007

(54) METHOD AND DEVICE FOR POWER TRANSMISSION IN A REEL-UP

(75) Inventors: Vesa Markkanen, Kirkkonummi (FI); Kalevi Vesterinen, Vantaa (FI)

(73) Assignee: Metso Paper, Inc., Helsinki (FI)

( * ) Notice: Subject to any disclaimer, the term of this patent is extended or adjusted under 35 U.S.C. 154(b) by 85 days.

(21) Appl. No.: 10/487,814

(22) PCT Filed: Aug. 27, 2002

(86) PCT No.: PCT/FI02/00693

§ 371 (c)(1),
(2), (4) Date: Feb. 26, 2004

(87) PCT Pub. No.: WO03/018450

PCT Pub. Date: Mar. 6, 2003

(65) Prior Publication Data

US 2004/0238681 A1 Dec. 2, 2004

(30) Foreign Application Priority Data

Aug. 27, 2001 (FI) ..... 20011709

(51) Int. Cl.
*B65H 18/14* (2006.01)

(52) U.S. Cl. ..... 242/541.1; 242/542.3

(58) Field of Classification Search ..... 242/541.1, 242/542.3
See application file for complete search history.

(56) References Cited

U.S. PATENT DOCUMENTS

| | | | | |
|---|---|---|---|---|
| 3,858,821 | A * | 1/1975 | Beard et al. | 242/530.3 |
| 4,165,842 | A | 8/1979 | Mengel | |
| 4,179,330 | A | 12/1979 | Page | |
| 5,069,394 | A | 12/1991 | Panttila et al. | |
| 5,251,837 | A | 10/1993 | Kammann et al. | |

(Continued)

FOREIGN PATENT DOCUMENTS

EP 0 538 566 A1 8/1992

(Continued)

OTHER PUBLICATIONS

"Papermaking Part 3, Finishing", Book 10 of Papermaking Science and Technology series, title pages and pp. 162-163.

(Continued)

*Primary Examiner*—John Q. Nguyen
(74) *Attorney, Agent, or Firm*—Stiennon & Stiennon

(57) ABSTRACT

A continuous web (W) is reeled up on a center-drive assisted reeling core (C2, C3) to form a machine reel (R), and the reeling core (C2, C3) moves when the center drive (PD, SD) is coupled to the end of the reeling core. The rotating movement and torque necessary in the center drive (PD, SD) are transmitted from a stationary drive motor (PM, DM) to the end of the reeling core (C2, C3) by a power transmission (T) equipped with one or more joints, wherein the need to move the drive motor (PM, DM) along with the movement of the reeling core (C2, C3) is avoided. In a preferred embodiment of the invention the power transmission (T) is implemented by a belt drive, wherein by selecting the belt transmission in a suitable manner, it is also possible to avoid the need to use a separate gear system.

9 Claims, 5 Drawing Sheets

U.S. PATENT DOCUMENTS 5,375,790 A 12/1994 Svanqvist
5,431,357 A 7/1995 Rüegg
5,584,445 A * 12/1996 Kremar ..... 242/541.1

FOREIGN PATENT DOCUMENTS

EP 0 595 229 A3 10/1993
WO WO 94/24033 A1 10/1994
WO WO 03/018450 A1 3/2003

OTHER PUBLICATIONS

International Search Report for PCT/FI02/00693.
International Preliminary Examination Report for PCT/FI02/00693.

* cited by examiner

METHOD AND DEVICE FOR POWER TRANSMISSION IN A REEL-UP

CROSS REFERENCES TO RELATED APPLICATIONS

This application is a national stage application of International Application No. PCT/F102/00693, filed Aug. 27, 2002, and claims priority on Finnish Application No. 20011709, filed Aug. 27, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in a reel-up used for the reeling up of a paper web or the like. Furthermore, the invention relates to a center drive device of a reel-up for implementing the method.

A web that is several meters wide and comes directly from a paper machine or a finishing apparatus connected thereto continuously in an on-line type manner is reeled in a so-called reel-up to form successive machine reels around reeling cores, so-called reel spools. These large machine reels, which substantially comply with the production width of paper, function as kind of intermediate storages for the paper web between off-line type finishing devices. In front of off-line type finishing devices, such as coating machines for paper web, a so-called unwinder is used to guide the web reeled up in the preceding reeling device from successive reels to said finishing apparatus. Said preceding reeling device can be a so-called re-reeler in which the machine reel reeled in a reel-up of a paper machine is unwound in the unwinder of the intermediate reel-up, and it is reeled up again in the reel-up of the intermediate reel-up to form a reel that is suitable for the finishing process in question. In the end of an off-line finishing apparatus, such as an off-line coating machine, there is typically yet another reel-up in which the paper web coming from said apparatus is reeled around the reeling core again to form a machine reel.

There are several solutions of different types for reel-ups, including the so-called center-drive assisted reel-up which is the reel-up type generally in use at present. This reel-up type utilizes a reeling cylinder equipped with a center drive as well as a machine reel that is in nip contact with the same in the reeling station. The paper web is guided on the machine reel via a nip formed between the reeling cylinder and the machine reel that is being formed. In center-drive assisted reel-ups the reeling core of the machine reel is also provided with a center drive of its own to improve the control of the reeling process. In a solution that is generally used in center-drive assisted reel-ups, the reeling cylinder has a stationary position and thus the center-driven reeling core of the machine reel moves on its support in relation to said reeling cylinder at different stages of the reeling up process and/or as the amount of web around the reeling core grows.

The present invention relates especially to reel-ups of the above kind in which the reeling core of the machine reel that is being formed is arranged to move during the reeling up process as the center drive of the machine reel is coupled to said reeling core.

The book by Mikko Jokio: Papermaking Part 3 Finishing, published by Fapet Oy, ISBN 952-5216-10-1, 1999, pp. 162 to 163, discloses a reel-up based on the use of a stationary reeling cylinder. In the following, the operating principle of said reel-up will be discussed briefly.

According to the facts stated in the above-mentioned reference, the reeling up to a new empty reeling core is started in a so-called primary reeling device. First, the primary reeling device receives the empty reeling core from a storage on end support on arms or the like that function as gripping means. Said storage is located above the reeling cylinder and the paper web, in an area that is within reach of the primary reeling device. The primary reeling device contains a so-called primary center drive that is coupled to a power transmission connection with the other end of the reeling core. By means of the primary center drive the empty reeling core is accelerated to a speed corresponding to the speed of the reeling cylinder and the paper web, whereafter the reeling core is transferred closer to the reeling cylinder, and further in nip contact with the reeling cylinder, at the same time performing the threading of the paper web to said reeling core at a suitable stage. The aforementioned threading and thus the change of the reeling up process to a new reeling core are usually conducted in a so-called flying change without reducing the speed of the paper web entering the reel-up during the change. The reeling up to the reeling core located in the primary reeling device continues now by means of the primary center drive until the preceding full machine reel has been transferred out of the way. At a suitable stage the primary reeling device lowers the reeling core that is under its control on end support on rails, on carriages moving on the rails, or on a corresponding support, the structures implementing the support being dimensioned to support the eventual weight of the full machine reel that is being formed. The reeling core and the new machine reel formed thereon are transferred away from the control of the primary reeling device by changing the so-called secondary center drive released from the finished machine reel to the free end of the reeling core, and by releasing the primary center drive of the primary reeling device from the other end. During this change the torque necessary for rotating the reeling core is ramped, i.e. changed gradually from said primary center drive to said secondary center drive and the reeling up process continues during said change without interruptions. When the primary reeling device has become free, the primary reeling device returns to retrieve the next empty reeling core from the storage for the next change.

The above-mentioned primary center drive and secondary center drive are both composed of the following main components: the actual drive motor, a gear system transforming the transmission ratio of the rotating speed of the motor into a suitable level, as well as a coupling mechanism engaging to the end of the reeling core. In solutions of prior art the aforementioned components of the primary center drive are fixed to the primary reeling device itself, and thus they can move along with the reeling core located in the primary reeling device when the primary reeling device turns from one position to another in the different operating stages of the reeling up process. In solutions of prior art the drive motor, the gear system and the coupling mechanism of the secondary center drive are also fixed on a moving base or the like, said base moving along with the machine reel as the diameter of the machine reel grows, and the reeling core moves in relation to the stationary reeling cylinder. U.S. Pat. No. 5,375,790 discloses in more detail a solution in which the unit composed of the drive motor, the gear system and the coupling mechanism of the secondary center drive moves on the side of the rail supporting the other end of the reel spool, thus following the movement of the reel spool and its reeling core.

One way of connecting the drive motor to the end of the reel spool is also disclosed in the U.S. Pat. No. 5,069,394.

The weight of the drive motor of the center drive is typically in the order of 2,000 kg, and the weight of the gear system coupled to the drive motor in the order of 1,200 kg. In order to load the structures of the reel-up symmetrically, counterweights are used in the opposite end of the reeling core to balance the weight of the drive motor and gear system that are coupled to the end of the reeling core and move along with the reeling core. When the motor, the gear system and the counterweights as well as the structures necessary for moving said components are taken into account, the total weight of the components and structures that need to be lifted up is in the order of 10,000 kg per one center drive.

In such reel-ups in which the primary and/or secondary drives are moved along with the reeling core, it is thus in solutions of prior art necessary to implement quite strong supporting and moving structures merely for the components relating to the center drive. This means that the implementation of said structures causes significant costs, because both the amount of work required therein and the amount of steel used as raw material are quite considerable.

In order to maintain the weight as low as possible the motors and gear systems used in the center drives must be selected by taking account especially the weight and size of the same, wherein the use of alternative and less expensive components is limited in solutions of prior art.

One harmful result of the great weight of the components of the center drives and the supporting structures of the same in reel-ups is still the fact that especially in the primary reeling device of the reel-up the weight of the components moving along with the primary reeling device of the primary center drive can complicate the accurate control of the nip load i.e. linear load between the reel that is being formed and the reeling cylinder. The nip load is an essential parameter used in the reeling up process, by means of which it is possible to affect the quality of the machine reel that is being formed and the preservation of the properties of the reeled-up paper web.

SUMMARY OF THE INVENTION

The main purpose of the present invention is to attain a method in the power transmission of a center drive of a reeling core moving during a reeling up process, by means of which method it is possible to avoid the above-mentioned problems of prior art caused primarily by the weight and size of the components necessary in the implementation of the center drives. It is also an aim of the invention to provide a center drive device of a reel-up implementing the aforementioned method.

To attain this purpose, the method according to the invention is primarily characterized in that the rotating movement and the torque necessary in the center drive are transmitted from the stationary drive motor to the end of the reeling core by means of power transmission equipped with one or more joints.

The device according to the invention, in turn, is primarily characterized in that the center drive device comprises a stationary drive motor as well as power transmission equipped with one or more joints to transmit the rotating movement and torque necessary in the center drive to the end of the reeling core.

The invention is based on the idea that the driving force of the center drive of the reeling core in the reel that is formed in the reeling up process and moves during said reeling process is transmitted to said reeling core from a stationary drive motor by means of articulated power transmission. Thus the arrangements necessary for moving in the drive motor itself as well as the problems caused by the same can be avoided. According to the invention, the articulated power transmission at the same time also replaces a separate gear system necessary in solutions of prior art. This will also reduce the number of components that need to be lifted up and moved when compared to the state of the art.

In a preferred embodiment of the invention, the power transmission from the rotating output shaft of the drive motor to the rotating shaft of the reeling core and/or to the coupling member coupled to said shaft is implemented by means of a belt drive mechanism utilizing one rotating intermediate shaft. In other words, the rotating movement and the torque are transmitted by means of belt drive from the first belt pulley arranged in the rotating output shaft of the drive motor to a second belt pulley arranged in said rotating intermediate shaft. The rotating movement and torque are transmitted by means of the belt drive further from a third belt pulley that is arranged in the intermediate shaft and rotates at the same speed with the second belt pulley to a fourth belt pulley arranged in the shaft/coupling member of the reeling core. By changing the mutual diameter of said belt pulleys it is possible to change the transmission ratio of said power transmission from the output shaft of the drive motor to the shaft of the reeling core, wherein the power transmission according to the invention substitutes for the use of a separate gear system or the like.

Thus, by means of the power transmission method and device according to the invention it is possible to significantly reduce the number and weight of the components that are moved along with the reeling core and that are necessary in the implementation of the center drive. The reduction in the weight of the center drive components moved along with the reeling core also reduces the need to use counterweights. This means that the corresponding supporting structures of the device become considerably simpler and lighter, and thus also less expensive to manufacture.

Another advantage of the invention is that the stationary motor can be implemented by means of less expensive alternatives, because the weight and structure of the operating motor do not restrict the selection of the motor type to be used to the same extent as in solutions of prior art in which it is necessary to move the motor. When the power transmission of the center drive is implemented by means of belt transmission, the use of a separate gear system can also be avoided when compared to solutions of prior art, which further reduces the costs of implementing the center drive. The structure of the power transmission device utilizing the belt transmission is simple and cheap as such, and in addition, the belt transmission naturally attenuates the undesirable shocks and impacts occurring in the power transmission. The maintenance of the belt transmission is also easy, it can be conducted rapidly, and thereby it is also cheap.

The articulated power transmission according to the invention can be utilized in reeling up as well as in the implementation of both a primary center drive and a secondary center drive. In other words, the power transmission method and device according to the invention also enables the movement of the reeling core along with the primary reeling device, as well as the movement of the reeling core when the reel that is being formed lies on the support of its actual supporting mechanism, such as rails or the like. In the latter situation, the movement of the reeling core is caused by the growth of the diameter of the machine reel that is being formed during the reeling up process, and by the resulting movement of the reeling core of the machine reel in relation to the stationary reeling core.

Furthermore, it is an advantage of the invention that by selecting the placement/distance of the intermediate shaft used in the belt drive in a suitable manner in relation to the shaft of the drive motor and the shaft of the reeling core, it is possible minimize such forces exerted on the reeling core by the power transmission of the center drive that have a harmful effect on the control of the nip contact and nip force. In other words, the power transmission method according to the invention does not exert such forces on the reeling core which would significantly affect the nip force and thus complicate precise control and maintenance of the nip force in the reel-up. The reduction in the number and weight of the components moving along with the reeling core of the center drive for its part also promotes the precise control of the nip force especially when the invention is applied to a primary center drive located in the primary reeling device of the reel-up.

The power transmission method according to the invention is suitable to be used especially in medium heavy or smaller reel-ups in which prior art implementation of the center drives causes significant costs when compared to the structure and costs of the entire apparatus. The invention can be applied in the reeling up process of a paper web coming either directly from a paper machine or from a finishing apparatus coupled in an on-line type manner to a paper machine. Furthermore, the invention can also be used in connection with off-line type finishing processes, as well as in reeling up taking place in so-called re-reelers.

Especially in medium heavy and smaller reel-ups it is possible to implement the power transmission method according to the invention by means of "medium tech" components that are less expensive than solutions of prior art. The power transmission method according to the invention does not increase the need for maintenance either or increase the functions required from the measurement, control or adjustment system of the reel-up.

The following more detailed description of the invention will more clearly illustrate for anyone skilled in the art, possible embodiments of the invention as well as advantages to be achieved with the invention.

BRIEF DESCRIPTION OF THE DRAWINGS

In the following, the invention will be described in more detail with reference to the appended drawings.

DESCRIPTION OF THE PREFERRED EMBODIMENTS

Figure 1:
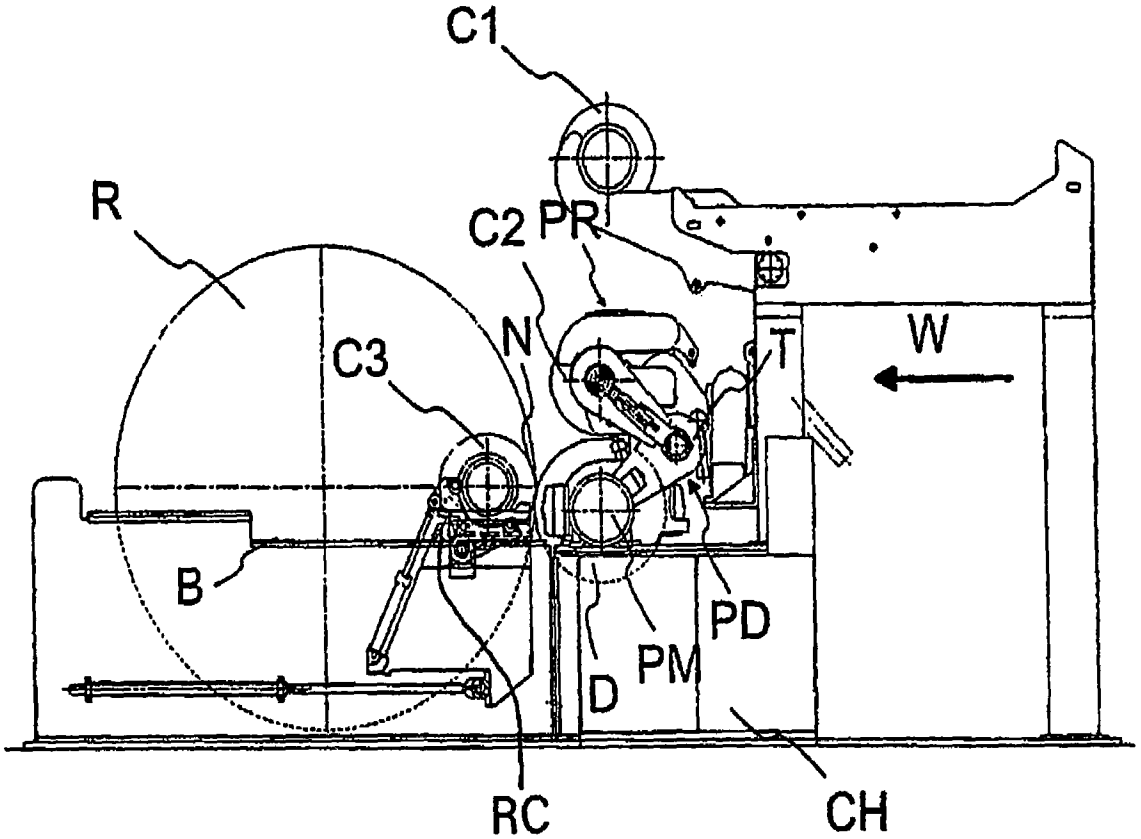
FIG. 1 illustrates in a side-view the act of applying the power transmission method according to the invention in a primary drive of a reel-up.
Figure 2:
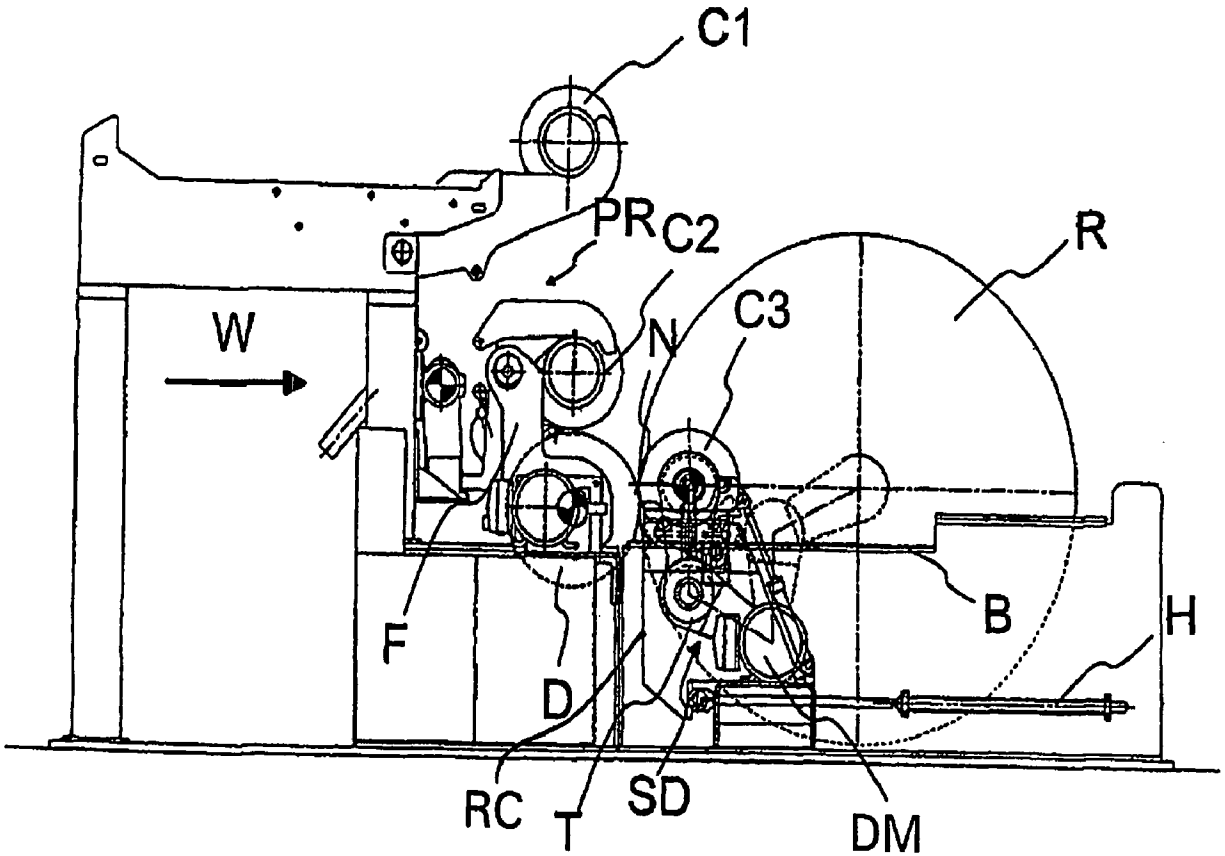
FIG. 2 illustrates in a side-view the act of applying the power transmission method according to the invention in a secondary drive of a reel-up according to FIG. 1.

FIGS. 1 and 2 show in opposite side views in principle a reel-up that is arranged to form a machine reel R from a paper web W coming from the sections of a paper machine or finishing machine for paper that precede the reel-up. In FIG. 1, the paper web W enters the reel-up from the right, according to the arrow shown in the drawing, and in FIG. 2 correspondingly from the left side. The machine reel R is formed in the reel-up in a known manner around a reeling core C3 (reel spool) by guiding the paper web W via the reeling cylinder D and the reeling nip N to the machine reel R. The machine reel R is loaded with an adjustable force towards the reeling cylinder D equipped with a center drive to attain the desired linear load in the reeling nip N.

The reeling up to a new empty reeling core C2 begins in the primary reeling device PR. At first, the primary reeling device PR receives the empty reeling core C1 from a storage located above the reeling cylinder D, placing it on end support on so-called primary forks F in the primary reeling device PR (in FIG. 2). The primary reeling device PR contains a so-called primary center drive of the reeling core C2, that is coupled to a power transmission connection with the other end of the reeling core C2. FIG. 1 shows the primary center drive PD of the reeling core C2 that utilizes the articulated power transmission method according to the invention. The primary center drive PD comprises a drive motor PM that is fixed in a stationary manner to the frame CH of the reel-up. According to the invention, the driving force of the primary center drive is transmitted from said drive motor PM to the reeling core C2 by using the articulated power transmission T, which articulated power transmission T at the same time also replaces the separate gear system necessary in solutions of prior art. By means of the primary center drive PD, the empty reeling core C2 is accelerated to a speed corresponding to the speed of the reeling cylinder D and the paper web W. When the full machine reel R has been transferred further away from the reeling cylinder D, at the same time giving room to the primary reeling device PR, the primary forks F of the primary reeling device PR as well as the reeling core C2 attached thereto turn in a known manner towards the supporting rails B for the purpose of cutting and threading the paper web W. The so-called primary nip between the reeling core C2 and the reeling cylinder D is closed at this stage at the latest. During the aforementioned turning of the primary reeling device PR, the articulated power transmission T according to the invention turns with the movement of the reeling core C2, thus transmitting the rotating movement and torque of the drive motor PM to the reeling core C2. The cutting of the paper web W and change of the same to a new reeling core C2 is conducted in a known manner. The aforementioned change is conducted normally as a so-called flying change without reducing the speed of the paper web W for the duration of the change. The reeling up to the reeling core C2 located in the primary reeling device PR continues now by means of the primary center drive PD until the drive of the reeling core has been transferred to a secondary center drive that will be described hereinbelow. Before the change, the full machine reel R has been transferred out of the way along supporting rails B further away from the reeling cylinder D in a known manner.

At this stage at the latest, the primary reeling device PR lowers the reeling core C2 under its control as well as the new machine reel formed thereon on end support on supporting rails B for the duration of the final stage of the reeling, if this has not been done already before the aforementioned change to conduct the change on the rails. The reeling core C2 is transferred away from the control of the primary reeling device PR by changing the so-called secondary center drive SD released from the machine reel to the other free end of the reeling core C2 (see FIG. 2) and by releasing the primary center drive PD of the primary reeling device PR from the opposite end. During this change the torque necessary for rotating the reeling core C2/C3 is ramped, i.e. changed gradually from said primary center drive PD to said secondary center drive SD and the reeling up process continues during said change without interruptions. When the primary reeling device PR has become free, the primary reeling device PR returns to retrieve the next empty reeling core C1 from the storage for the next change.

FIG. 2 shows in principle the secondary center drive SD of the reeling core C3 that utilizes the power transmission method according to the invention. Similarly to the above-described primary center drive PD, the secondary center drive SD also comprises a separate drive motor DM, which in the case of the secondary center drive SD is fixed in a stationary manner for example on the floor level, or to a base fixed to the base/frame of the reel-up. According to the invention, the driving force of the secondary center drive SD is transmitted from said drive motor DM to the reeling core C3 by means of articulated power transmission T. According to prior art, the machine reel R that is formed around the reeling core C3 can be supported at its ends by its bearing housings for example on a sledge, reeling carriages RC, etc. that move for example on supporting rails B, or the machine reel R may also be supported at its ends on rails directly by means of bearing housings located at the ends of the reeling core C3. As the reeling proceeds, the reeling core C3 moves on the support of the aforementioned supporting mechanism in relation to the stationary reeling cylinder D, said movement being caused by the growth of the diameter of the machine reel R that is being formed. The reeling cylinder D is rotated with a drive of its own. According to what is shown by broken lines in FIG. 2, the articulated power transmission T of the secondary center drive SD according to the invention turns in conjunction with the movement of the reeling core C3, thus transmitting the rotating movement and torque of the drive motor DM to the reeling core C3. The desired nip force and linear load are attained in a known manner by loading the machine reel R that is being formed against the reeling cylinder D by means of a hydraulic cylinder H. The hydraulic cylinder H is mounted between the frame CH and a carriage RC shown in FIGS. 1 and 2. The drive motor DM is placed in a stationary position for example on a base located on the floor.

Figure 4:
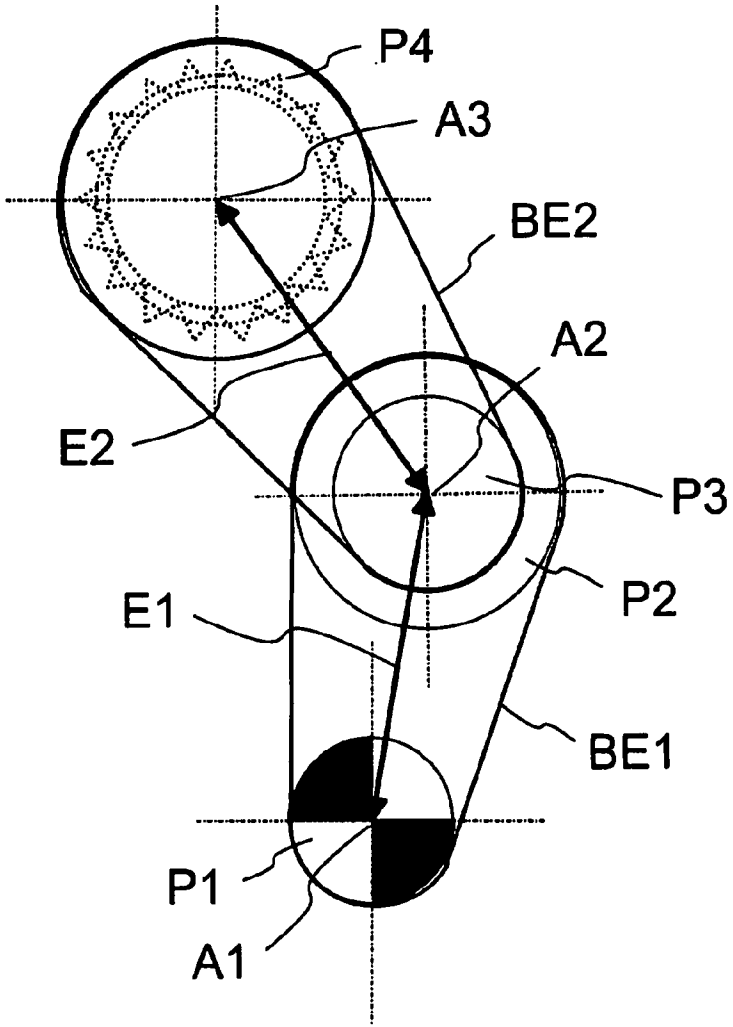
FIG. 4 illustrates the embodiment of FIG. 3 in another position.
Figure 3:
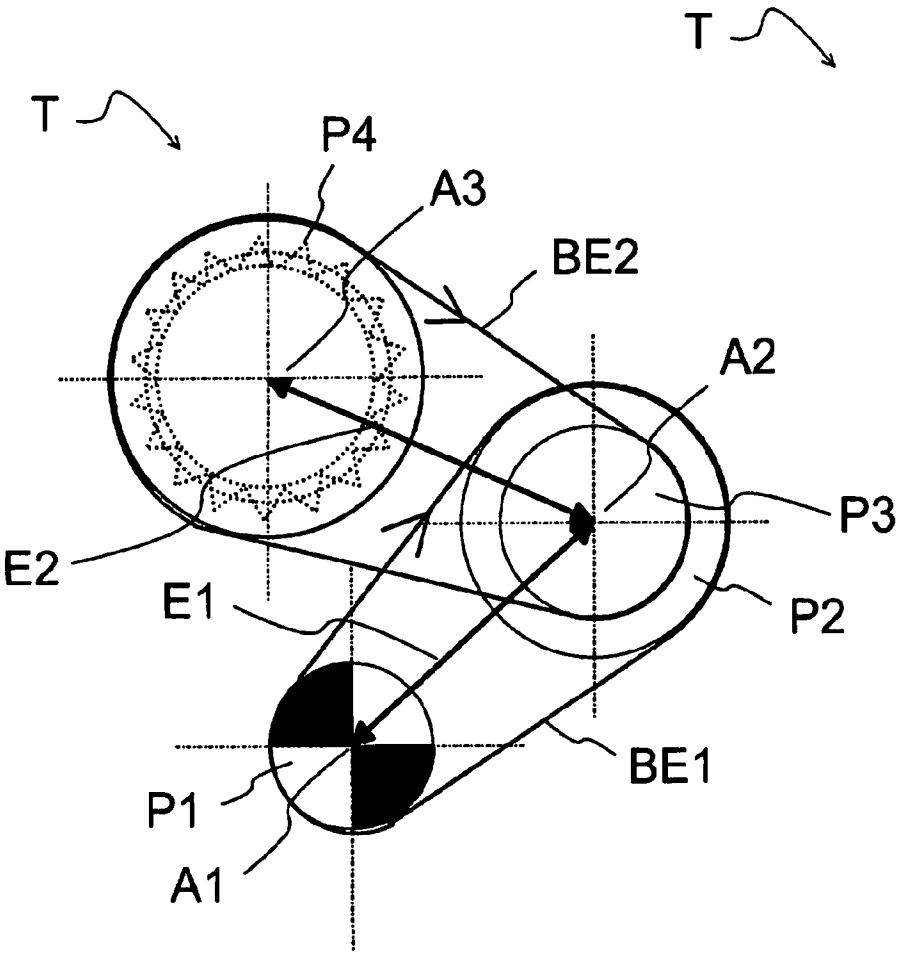
FIG. 3 illustrates in principle an embodiment of the articulated power transmission method according to the invention based on a belt drive.

FIGS. 3 and 4 illustrate in principle a preferred embodiment of the articulated power transmission T according to the invention that is based on a belt drive. From a first belt pulley P1 arranged in the rotating output shaft A1 of the drive motor the rotating motion and the torque are transmitted by means of a belt BE1 to a second belt pulley P2 arranged in a rotating intermediate shaft A2. From a third belt pulley P3 coupled to the intermediate shaft A2 and rotating at the same speed with said intermediate shaft and the belt pulley P2, the rotating motion and torque are transmitted further by means of a belt BE2 to a fourth belt pulley P4 coupled to the shaft/coupling member A3 of the reeling core. By means of a supporting member E1 that is supported at its ends in relation to the output shaft A1 and the intermediate shaft A2 of the drive motor and installed between said shafts, the tension of the belt BE1 is adjusted to a suitable level, and changes in the distance between the belt pulleys P1 and P2 are prevented when the power transmission T is loaded, i.e. the torque is transmitted. In a corresponding manner, a supporting member E2 is arranged between the intermediate shaft A2 and the shaft of the reeling core/coupling member. The supporting members E1 and E2 are supported by and connected to the intermediate shaft A2 in such a manner that the angle formed between said supporting members can change in a plane parallel to the longitudinal axis of the supporting members, in other words the joint of the power transmission T that is formed on the intermediate shaft A2 can bend on said plane. The supporting member E1 is supported and connected to the output shaft A1 of the drive motor in such a manner that the supporting member E1 can also turn on said plane in relation to the drive motor and the output shaft A1. The supporting member E2 is supported on the shaft A3 of the reeling core in a corresponding manner that enables the turning. The joint of the power transmission formed on the intermediate shaft A2 thus makes it possible for the distance between the shafts A1 and A3 to change, and the position of said shafts to change in relation to each other on the longitudinal plane of these supporting members E1 and E2. This has been illustrated by showing the power transmission T in FIGS. 3 and 4 on two different positions in which said positions, the mutual distance and position of the shafts A1 and A3 on said level are different.

By changing the mutual diameter of the belt pulleys P1 to P4 contained in the power transmission T according to the invention it is possible to change the transmission ratio of said power transmission from the output shaft A1 of the drive motor to the shaft A3 of the reeling core. Suitable transmission ratio can be selected for example between 2 to 8:1 (A1:A3). Thus, the rotating speed of the output shaft A1 of the drive motor that is typically too high as such for the shaft A3 of the reeling core can be reduced to a suitable level without the use of a separate gear system. The diameters P1 to P4 of the belt pulleys can all be different in size, or the diameters of some belt pulleys can also be equal in size. It is also possible that the diameters of all the aforementioned belt pulleys are equal in size, if the speed of rotation of the output shaft A1 of the drive motor is suitable.

Figure 5:
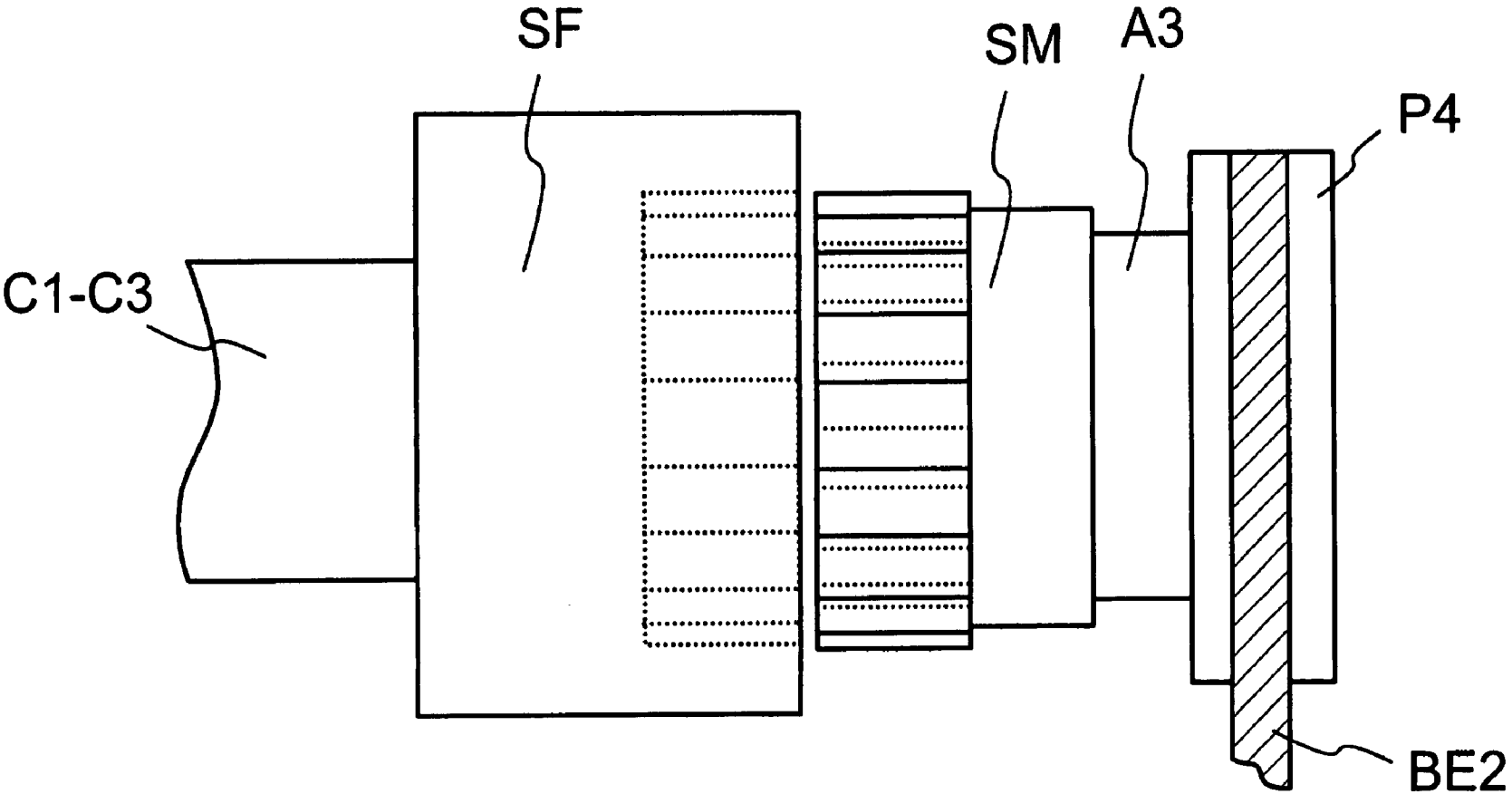
FIG. 5 illustrates in principle a coupling structure for coupling a center drive utilizing the power transmission method according to the invention to the shaft of a reeling core.

FIG. 5 also illustrates a possible coupling device connected to the end of the reeling core C1 to C3, by means of which it is possible to couple the power transmission T according to the invention to said reeling core. In FIG. 5 the rotating motion and torque transmitted by the belt BE2 are transmitted to the shaft A3 by means of a belt pulley P4 connected to said shaft. The shaft A3 contains a coupling member SM that is arranged to move in the longitudinal direction of said shaft and on the support of a splining or the like that is arranged on the shaft. The splining or the like on the outer periphery of the coupling member SM is provided with such a shape and dimensions that it fits in the inner splining of the counter coupling member SF arranged in the end of the reeling core C1 to C3. When the coupling member SM is moved on the shaft A3 in such a manner that the splining in the coupling member SM is connected to the corresponding inner splining of the counter coupling member SF, the rotating movement of the shaft A3 is coupled to the reeling core C1 to C3 in a corresponding manner. When the coupling member SM moves axially against the counter-coupling member SF in the end of the reeling core C1 to C3, the belt pulley P4 advantageously remains in its place in the axial direction.

In order to follow the movement of the center-driven reeling core C1 to C3, as well as to connect the power transmission (to align the coupling members SM and SF), the shaft A3 must be arranged to move in conjunction with the functions/actuators of the reel-up. In the case of the primary reeling device PD of the primary center drive PR, the shaft A3 of the power transmission T can be attached to the primary fork F of the primary reeling device or to another suitable member in the primary reeling device PR. In the case of the secondary center drive SD, the shaft A3 of the power transmission T can be attached to a carriage or the like moving on support rails B, said carriage being arranged to support the reeling core C3 in a known manner during the reeling up process. The attachment of the shaft A3 to a suitable member in the primary reeling device PR and correspondingly to the carriage moving on the rails B can be implemented by means of any suitable mechanical solution known as such that enables the rotation of said shaft. The return movements of the primary reeling device PR as well as said carriage or the like to retrieve the next reeling core and to connect the center drive to the end of the reeling core to be retrieved can be implemented by means of suitable solutions that are obvious for anyone skilled in the art.

In the following an advantage to be attained by means of the method according to the invention will be described in more detail when the invention is applied in the power transmission of the primary center drive of the reel-up.

Figure 6:
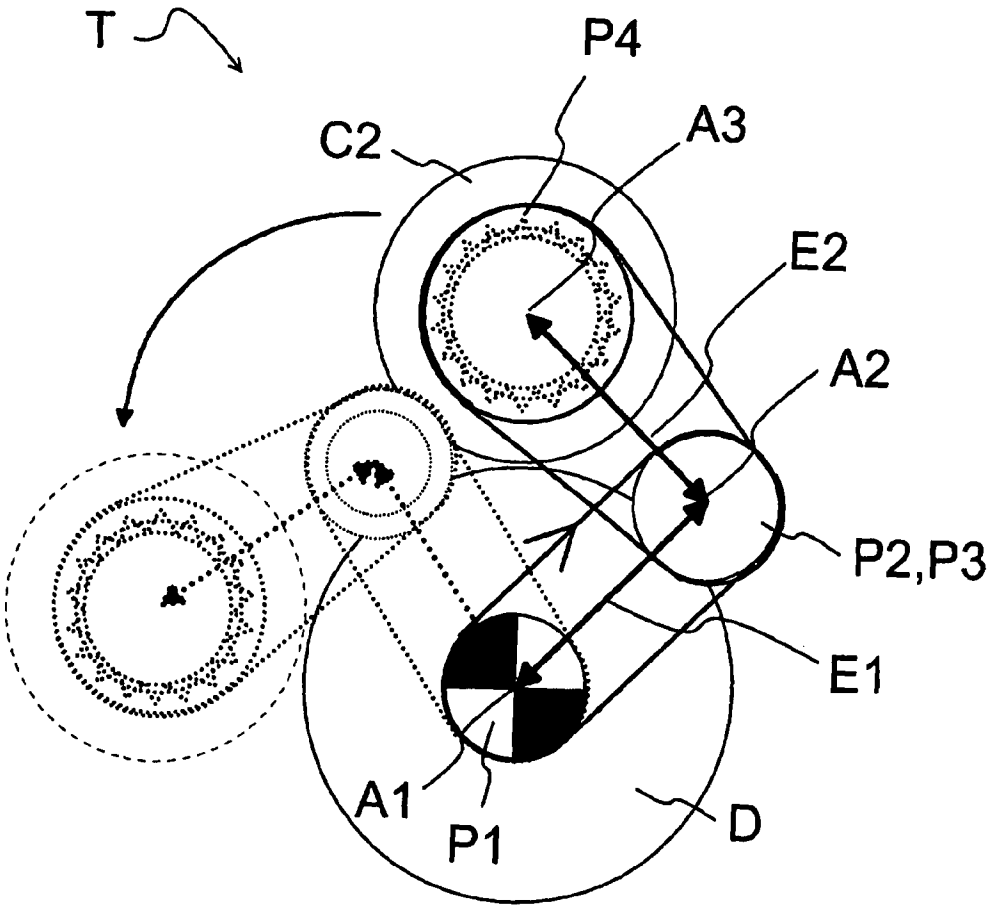
FIG. 6 illustrates in principle the act of applying the belt drive according to the invention in the primary center drive of a reel-up.

FIG. 6 shows, in principle, a primary center drive of a reel-up according to the invention, implemented by means of a belt drive. In the embodiment of FIG. 6, the output shaft A1 of the drive motor of the primary center drive is positioned concentrically with the central shaft of the reeling cylinder D, and the supporting members E1 and E2 are equally long, and the shafts A1, A2 and A3, in turn, are arranged to such a position with each other that in the end of the intermediate shaft A2, the supporting members E1 and E2 form together an angle of 90 degrees. Thus in an ideal situation and when the weight of the components themselves is not taken into account, and if the diameters of the belt pulleys P1 to P4 are equally large as well, the forces resulting from the power transmission behave in accordance with the basic principles of mechanics in such a manner that significant forces directed towards the shaft A1 or away from the same do not affect the shaft A3. In other words, forces that substantially affect the nip force between the reeling core C2 and reeling cylinder D do not affect the shaft A3 of the reeling core C2 as a result of the power transmission T. In practice, for example the diameters of the belt pulleys P1 to P4 are not equal in size, because they are utilized to affect the transmission ratio of the power transmission, but still said force effects in the direction of the nip force remain relatively insignificant in practice as well. When the primary center drive turns in the primary reeling device with the reeling core C2 towards the supporting rails or the like, as shown with broken lines in FIG. 6, the mutual position of the shafts A1, A2 and A3 remains substantially the same, and thus also the force effects in the direction of the nip force remain substantially constant. Because the weight of the components of the primary center drive that are to be attached to the primary reeling device is considerably smaller when the power transmission method according to the invention is utilized than in solutions of prior art, it is possible to adjust the nip force accurately especially at the initial stage of the reeling. As it is well known, controlled reeling up of the so-called bottom area of the reel is an essential factor for a successful final reeling of the machine reel and for preserving the quality of the paper web stored on the reel.

It will, of course, be obvious for anyone skilled in the art that the various embodiments of the invention are not restricted solely to the above examples relating to reeling up, but they may vary within the inventive aspects of the claims to be presented hereinbelow.

Although the use of the invention is in the above-presented examples described solely in connection with a reel-up of certain type, the method according to the invention can also be applied in other kinds of reel-ups. In reel-ups for example a mere reeling cylinder can be replaced with a combination of a reeling cylinder and a belt or with another mechanical solution known as such that functions in a nip-like manner. In the mutual arrangements of the machine reel and the member functioning like a stationary nip it is possible to utilize modes of operation known as such, including different carrier and auxiliary roll solutions. Instead of end support, the machine reel to be reeled up can also be supported by means of various carrier rolls. The primary reeling device of the reel-up can also be implemented by different methods of prior art.

The drive motor functioning as a power source for the center drive can be an electric motor, a hydraulic motor or another suitable power source producing the rotating movement. The speed of rotation of the drive motor can be implemented with solutions of prior art.

In the embodiment of the invention that is based on the use of a belt drive, the supporting member E1 between the output shaft A1 and the intermediate shaft A2 as well as the corresponding supporting member E2 between the intermediate shaft A2 and the shaft/coupling member A3 of the reeling core can be implemented by means of any suitable structural solution known as such. The power transmission T according to the invention that is implemented by means of a belt drive can have an open structure, or it can also be partly or entirely encased. The casing structure of the power transmission T can also be implemented in such a manner that said casing structure itself functions as supporting members E1, E2.

It is also obvious for anyone skilled in the art, that the supporting members E1, E2 and/or casing structures connecting the belt pulleys can be equipped with a control mechanism that enables the adjustment of the distance between the belt pulleys P1 and P2, as well as P3 and P4 to adjust the tension of the belts, and further to change the belts during maintenance. Furthermore, the possible casing structure of the power transmission is advantageously such that the belts can be easily checked and changed, if necessary.

The belts BE1, BE2 that are used in the belt transmission can be for example of flat belt, cone belt, cogged belt or form belt type and manufactured of any material suitable for the purpose. The power transmission between the shafts A1 and A2, as well as the power transmission between the shafts A2, A3 correspondingly, can be implemented either by means of one belt or several adjacent belts. On the intermediate shaft A2 the belt pulleys P2 and P3 may be placed adjacently against each other, or alternatively on different points in the longitudinal direction of the intermediate shaft, wherein a larger sideways shift is produced between the belts BE1 and BE2. The shafts A1 to A3 do not necessarily have to be parallel to each other, but by utilizing the rotation of the belts BE1 and/or BE2, it is also possible to implement the power transmission between divergent shafts A1 to A3.

The power transmission T according to the invention can also be implemented by means of more than one intermediate shaft, and by utilizing a turning joint that is formed by means of the intermediate shafts.

The coupling structure that couples the rotating motion on the reeling core can be of any known type, and it can also contain means for example to subdue and/or secure the function of the coupling member and/or the reduce the noise.

It is obvious for anyone skilled in the art, that the articulated power transmission according to the invention can also be implemented entirely without a belt drive, for example by means of cardan shafts and/or different types of pinion transmissions.

The invention claimed is:

1. A method of reeling up a paper web in connection with the manufacture of a paper web, or in an off-line reeling up process, using a reel-up having a frame, the method comprising the steps of:

bringing a reeling core up to a rotation speed which matches a rotation speed of a winding cylinder by transmitting power from a first motor fixed to the reel-up frame through a first articulated power transmission having an articulated joint, and the first articulated power transmission engaging in power coupling relation a first end of the reeling core;

bringing the reeling core into nipping engagement with the winding cylinder and positioning the reeling core on a carriage mounted for linear motion on spaced apart rails;

during the previous step beginning the winding of the paper web on to the reeling core;

connecting a second motor fixed to the reel-up frame to a second end of the reeling core opposite the first end of the reeling core with a second articulated power transmission having an articulated joint; and transitioning between driving the reeling core with the first motor through the first articulated power transmission, to driving the reeling core with the second motor through the second articulated power transmission.

2. The method of claim 1 wherein during the step of transitioning, power necessary for rotating the reeling core is changed gradually from said first motor to said second motor and the reeling up process continues during said change without interruptions.

3. The method of claim 1, wherein the power transmitted from the first drive motor to the first end of the reeling core is transmitted by the first articulated power transmission utilizing a belt drive mechanism.

4. The method of claim 3, wherein the power is transmitted from an output shaft of the first motor to the first end of the reeling core, and is transmitted to a single intermediate shaft, and is transmitted from the single intermediate shaft to a third shaft which is coaxial with the reeling core and coupled directly to the reeling core.

5. The method of claim 1, wherein the second articulated power transmission connects to the reeling core through a shaft which is coaxial with the reeling core.

6. A method of reeling up a paper web in connection with the manufacture of a paper web, or in an off-line reeling up process, using a reel-up having a frame, the method comprising the steps of:

bringing a reeling core up to a rotation speed which matches a rotation speed of a winding cylinder by transmitting power from a first motor fixed to the reel-up frame through a first articulated power transmission having an articulated joint, and the first articulated power transmission engaging in power coupling relation a first end of the reeling core;

bringing the reeling core into nipping engagement with the winding cylinder and positioning the reeling core on a carriage mounted for linear motion on spaced apart rails; and during the previous step beginning the winding of the paper web on to the reeling core.

7. The method of claim 6, wherein the power is transmitted from an output shaft of the first motor to the first end of the reeling core, and is transmitted to a single intermediate shaft, and is transmitted from the single intermediate shaft to a third shaft which is coaxial with the reeling core and coupled directly to the reeling core.

8. A reel-up with a center drive device, comprising:

a frame;

a reeling cylinder mounted to the frame;

a pair of spaced apart linear rails extending away from the reeling cylinder;

a reeling core about which a continuous web can be wound to form a machine reel, the reeling core arranged so that a forming machine reel will engage the reeling cylinder at a nip, the reeling core having a first end and a second end;

a primary reeling device in empty reeling core receiving relation to a reeling core storage located above the reeling cylinder, the primary reeling device having arms arranged to grip the first end and the second end of the reeling core on end supports;

wherein the primary reeling device contains a first center drive device having a first drive motor fixed in a stationary manner to the frame at a first level, and an articulated power transmission extending from the first drive motor and coupled to the first end of the reeling core, wherein the articulated power transmission has at least one joint which accommodates motion of the center-drive reeling core with respect to the drive motor by turning of the at least one joint while power in the form of rotating movement and torque is transmitted from the first drive motor to the first end of the reeling core; and wherein the articulated power transmission, when connected to the first end of the reeling core, allows the reeling core to move along the rails a selected distance.

9. The reel-up of claim 8, further comprising a secondary reeling device which contains a second center drive device having a second drive motor fixed in a stationary manner to the frame at a second level below a first level of the first motor, the second center drive device having an articulated power transmission extending from the second drive motor and coupled to the second end of the reeling core, wherein the second power transmission has at least one joint which accommodates motion of the center-drive reeling core with respect to the second drive motor by turning of the second center drive device at least one joint while power in the form of rotating movement and torque is transmitted from the second drive motor to the second end of the reeling core.

* * * * *